United States Patent [19]

Ross, Jr. et al.

[11] 4,022,570

[45] May 10, 1977

[54] WARM FORM COOLING AND HEAT RECOVERY TUNNEL

[75] Inventors: James W. Ross, Jr., Dover; Francis H. Bricmont, Pittsburgh, both of Pa.

[73] Assignee: Caterpillar Tractor Co., Peoria, Ill.

[22] Filed: May 5, 1976

[21] Appl. No.: 683,587

[52] U.S. Cl. ..... 432/82; 432/129; 432/168; 432/124; 432/153

[51] Int. Cl.$^2$ ..... F27D 15/02; F27D 13/00

[58] Field of Search ..... 432/82–85, 432/78, 124, 129, 131, 138, 139, 153, 163, 168, 169, 192, 221

[56] References Cited

UNITED STATES PATENTS

| | | | |
|---|---|---|---|
| 312,341 | 2/1885 | Duryea | 432/129 |
| 1,265,097 | 5/1918 | Litinsky | 432/168 |
| 1,526,583 | 2/1925 | Beasley | 432/82 |
| 1,549,379 | 8/1925 | Pike | 432/139 |
| 2,530,595 | 11/1950 | Blaha | 432/82 |
| 3,063,878 | 11/1962 | Wilson | 432/82 |

*Primary Examiner*—John J. Camby
*Assistant Examiner*—Henry C. Yuen
*Attorney, Agent, or Firm*—Phillips, Moore, Weissenberger Lempio & Majestic

[57] ABSTRACT

A heat transfer apparatus for controlling the temperature of a formed workpiece is provided. The apparatus is in the form of a multi-tier rotary preheat, quench and heat recovery tunnel which provides for transfer of heat between tiers from workpieces to be cooled to workpieces to be heated, thereby conserving heat energy. Transfer of heat is accomplished by means of fans interconnected with the tier levels of the tunnel. A control system ensures proper temperature of air, passing through a hot-air fan, which is removed from a second level and transferred to a first level. Means are provided for loading slugs to be preheated prior to forming onto a first annular tray on the first level and for removing same after it has completed a single rotation about the cooling tunnel. After being further heated in an induction furnace, the slug is warm formed in a press to a desired configuration. The shaped workpiece is then transferred to the tunnel and loaded onto a second tier on a second level, below the first level. As the workpiece on the second tier completes a single rotation in a direction counter to the direction of rotation on the first tier, heat is transferred using circulated air as a transfer medium from the workpiece to the slug by means of the hot-air fan. The cooled workpiece on the second tier is transferred after a single rotation to a third tier on a level therebelow and moves in the same direction as the second tier. A air/water quench is provided on the third level and a cold-air fan circulates the moist air therein. Hot, dry and warm, moist air are available from the hot-air fan and quench-air fan, respectively, for plant process requirements.

11 Claims, 7 Drawing Figures

WARM FORM COOLING AND HEAT RECOVERY TUNNEL

CROSS REFERENCE

Cross reference is made to application Ser. No. 683,434, filed May 5, 1976, to Francis H. Bricmont, and also assigned to the same assignee hereof, describing a related method.

BACKGROUND OF THE INVENTION

This invention relates to a heat transfer aparatus for controlling the temperature of warm-formed workpieces. More particularly, this invention relates to a rotary preheat and quench tunnel for thermally conditioning such workpieces.

Warm forming of workpieces is a process frequently encountered in the manufacturing industry. With such process, metal billets or slugs are preheated to a desired preheat temperature from their normal ambient air temperature of about 70° F and placed in, for example, a forming press. The press mechanically works the slug into a desired workpiece shape or form. By preheating the workpiece, flow of the metal in the forming process is facilitated. The mechanical working of the preheated slug into the workpiece form raises the temperature significantly (approximately 200° F). For example, after warm forming, the metal workpiece may achieve a temperature of 1,300° F. After leaving the forming press, it is desirable to have a cooling in air to below the Martensite temperature of about 1,200° F. This slow cooling is desirable in order to ensure proper grain formation in the formed part or workpiece. This is followed by a water quench to take the workpiece back to ambient temperature at which it may be easily handled.

Currently, temperature-conditioning apparatus and methods in use with warm-forming operations are unduly costly in terms of space and energy. With regard to space, current processes require numerous pieces of equipment for heating the slug, transferring it to the forming press, then cooling and quenching the formed workpiece. Numerous mechanical transfer stations are required for transferring the slug and formed workpiece. Typically, a straight-line orientation of transfer from process to process is required.

With respect to energy, heat is first added to the slug from an outside source such as an induction heater in the preheating operation. Mechanical working of the slug causes additional heating of the part. Then, a slow cooling process is imposed and the heat energy taken from the formed workpiece is essentially wasted. Further, prior quenching processes involve a direct quench whereby the workpiece is dropped into a bath of cold water. This bath quench is overly severe in that it takes the temperature of the workpiece down in step-wise fashion as opposed to a more desirable gradual quench.

SUMMARY AND OBJECTS OF THE INVENTION

The present invention includes an apparatus for thermally conditioning warm-formed parts both before and after the warm-forming process. It includes preheating of the billets to be formed by drawing heat away in a heat exchange process from already-formed billets or workpieces subsequent to their exiting from a warm-forming press. Further temperature conditioning of the workpiece is accomplished by using a gradual quench of recirculated air and water and fine spray nozzles.

Thermal and humidity-conditioned air is available for building space, heating and process requirements.

More particularly, the invention provides a warm-formed cooling tunnel of generally "donut" or annular shape. The tunnel includes three vertically-spaced and annularly shaped trays which are on three separate levels. In this manner, plant space is conserved.

A billet of metal material, such as a steel slug, is loaded onto a first tier tray at a first station by means of a conveyor mechanism. The billet, on entering the first station, is at approximate ambient temperature, or 70° F.

A mechanical drive means is associated with each of the three tier trays so that billets on the highest or first level tier rotate or move in a clockwise direction while workpieces on the middle and lowest level or second and third tier trays move in a counterclockwise direction. This rotational difference in direction between the first and the second and third tier trays is important for heat transfer considerations. The drive means associated with the tier trays have vertically upstanding partitions or arms so that sequentially loaded slugs or workpieces are separately contained and moved or rotated over the trays. Upon completing a full circuit of the tunnel, an unloading mechanism removes the preheated slug at about 200°–250° F to a conveyor where it is conveyed either to a forming press or to an intermediate induction heater for further preheating.

The preheating of the slug while making the circuit of the tunnel is accomplished by means of heat energy transferred from formed workpieces on the second or next lower tier tray in the following manner. After leaving the warm-form press at a temperature of between 1,300° and 1,450° F, the conveyor transfers the mechanically worked workpiece to an entry station on the second tier level. The warm workpiece makes a circuit of the tunnel in the direction opposite to the direction of the slugs on the first or upper tier tray. In doing so, it gives up heat to the air in the second level, and by convective transfer such heat is transferred through the first tier tray, and by convection to the slugs rotating thereon. A small amount of radiant transfer may also occur from the workpieces to the underside of the first tier trays. Convective heat transfer between the first and second levels is ensured by means of a high-velocity air flow over the parts produced by means of a hot-air fan which is interconnected by conduits between the first and second levels. Hot air is drawn from the second level, pass through the hot-air fan, and blown into the first level where it convectively heats the slugs.

Air is available at the outlet of the hot-air fan at between 500°–800° F. Air drawn off at this point is mixed with air drawn from the cold-air fan and this mix at about 300°–500° F is available for plant space heating requirements. A control system is provided so that the temperature of the hot air exiting from the second level may be mixed with ambient air prior to injection into the first level if the air temperature is too high. A duct heater is included to preheat the system before hot-formed pieces are placed in the system.

After completing a full circuit, the workpiece on the second tier tray is at approximately 500°–800° F and drops down a chute to the lowest or third level tier tray. As the cooled workpiece completes a circuit of the third level, a number of atomizing quench nozzles spray a cooling fluid of air-atomized water on the slowly rotating workpiece. An unloading mechanism removes the cooled workpieces from the third tier tray to a conveyor just after a final spray quench of water reduces the temperature of the workpieces to approximately ambient temperature. The conveyor transfers the cooled workpieces to a parts bin.

While in the third level, a moist air/water mixture is allowed to circulate by means of a cold-air fan which draws off the mixture from the third level and transfers it to a cold-air duct beneath the third tier tray. Conditioned moist air at approximately 200° F is available at the exit from the cold-air fan. Hot air from the hot-air exhaust (not shown) is added to produce a mix for plant process requirements.

In this manner, energy is efficiently conserved since formerly wasted heat is put to use to first preheat slugs or billets, and is additionally available for plant space or process heating requirements. While heaters, such as induction furnace heaters, are still required to preheat the slugs, some of the heating is accomplished by the formerly wasted heat. In addition, plant process and heating requirements are at least partially satisfied by otherwise-wasted heat from this invention. Additionally, the stacked tiers of the apparatus result in a considerable savings of space and consequently of cost. It should be noted that the third or lowermost tier is thermally uncoupled from the upper two tiers which act as a counterflow heat exchanger.

It is therefore the primary object of this invention to provide an improved apparatus for controlling the temperature of warm-formed parts.

It is a further object of the this invention to provide for useful recovery of otherwise-wasted heat from warm-formed parts by using its heat to preheat a cooled slug as well as provide additional temperature and humidity-conditioned air for plant process and space heating requirements.

It is a further object of this invention to provide an apparatus whereby otherwise-wasted heat from warm-formed parts may be used for building heating requirements.

It is a further object to provide controlled cooling of warm-formed parts, thereby eliminating the necessity of an annealing process and consequent cost and equipment attendant thereto.

It is a further object of this invention to provide such an apparatus which is conserving of space and provides for the continuous processing of parts between the warming and cooling steps and thereby eliminates the necessity of transfer stations and attendant equipment.

It is a further object of this invention to provide such an apparatus having multiple-stack tiers of trays for transfer of parts between tiers to minimize space requirements and thereby equipment costs.

DETAILED DESCRIPTION

Figure 1:
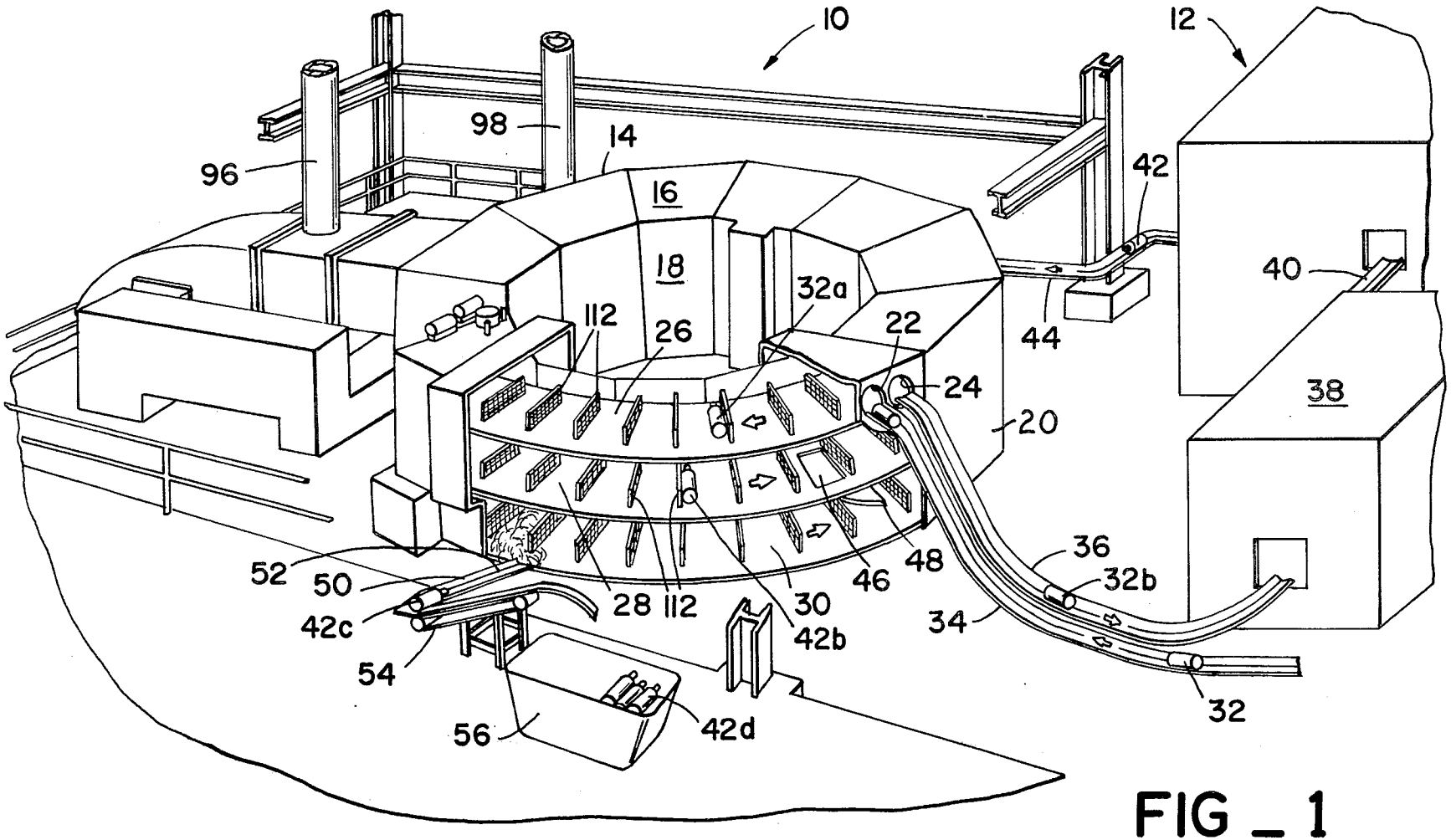
FIG. 1 is a top-quarter isometric view partially cut away of the apparatus of the instant invention illustrating the method-flow steps thereof.

Turning to FIG. 1, there is shown generally at 10 a warm-form cooling apparatus with thermally conditioned parts to be formed in a warm-form press shown generally at 12. The warm-form press may be a conventional type of press such as a hydraulic press capable of converting billets or slugs into finished or intermediate parts or workpieces.

The apparatus consists of a generally "donut" or annular-shaped housing 14 having an annular top wall portion 16 and inner and outer circular sidewalls 18, 20, respectively. Openings as at 22, 24 are contained in the housing to allow the loading and removal of slugs and workpieces therefrom, as will be more fully described hereinafter. Within the housing 14 are located three stationary annular trays, one above the other in stacked relation. The first or uppermost tier tray 26 has a drive means which is rotatable in a clockwise direction, as shown by the narrow, by means of a drive mechanism, as will be described hereinafter. The second or Intermediate tier tray 28 has a similar drive means; however, it operates in the counterclockwise direction, as also indicated by the arrow. The third or lowermost tier tray 30 has a drive means which also moves in the counterclockwise direction, as also shown by an arrow. Either a gear motor or, alternatively, a hydraulic motor drive means may be used.

As shown in the figure, a cold slug or billet 32 at approximately ambient temperature (70° F) is loaded onto a first of a series of conveyors 34, and is loaded onto the uppermost tier tray which defines a first level at a first or entry station through opening 22. The part rotates as shown at 32*a* in a clockwise direction until it completes a full circuit of the housing or tunnel 14 where it is ejected and transferred by a second conveyor 36, as shown at 32*b*, to an induction furnace 38 for additional preheating. After leaving furnace 38, a third conveyor 40 transfers the now-preheated part through the warm-forming press for forming into the desired workpiece form. The workpiece or formed part 42 leaves the press on a fourth conveyor 44 and through an opening (not shown) in housing 14. A loading mechanism loads the workpiece into housing 14 and onto the second tier tray 28 at a first station whereupon it makes a circuit of the housing to a second station defined by a generally rectangular floor opening 46 in second tier tray 28. In making the circuit-to-floor opening 46, the part **42*b* gives up heat to the next highest or uppermost tier tray 26 and the to-be-preheated slugs 32*a* thereon. In this manner the apparatus acts as a counterflow heat exchanger, exchanging heat from the mechanically worked workpieces to be cooled, to the slugs to be preheated. After sliding down a ramp 48, workpieces which may be cooled at approximately 500°–800° F further circulate on the lowermost or third tier tray 30 in a quenching process to an exit station wherein an exit/unloading mechanism 50 in the form of a reciprocable plunger pushes the now-cooled workpiece 42*c* along a ramp 52 and onto a fifth conveyor 54. The part 42*b* then drops into a transfer box 56.** While the first and second tier trays are thermally coupled for transfer of heat from the worked part to the part to be preheated, the third tier tray is not so coupled, as will be hereinafter described. It provides merely the quenching of the heated workpiece.

Figure 3:
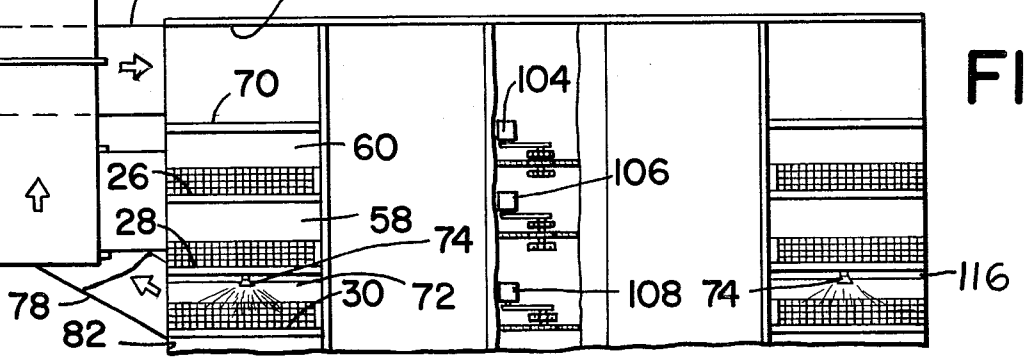
FIG. 3 is a side-elevation view in partial cross section of the apparatus taken along lines III—III in FIG. 2 partially cut away to show details thereof, especially cross-sectional view taken along lines IV—IV in FIG. 2, and showing tray divider details.
Figure 4:
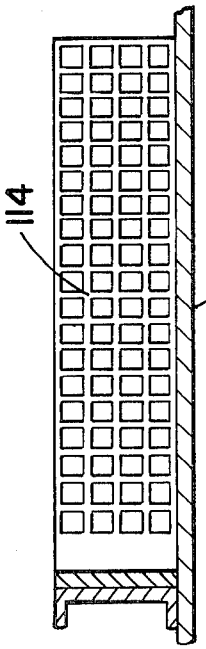

Turning to FIGs. 3 and 4, the details of thermal coupling may be more readily appreciated. While a certain amount of heat transfer from parts on intermediate tier tray 28 at a second level 58 does occur through tier tray 26 thereabove to a first level 60, this is not the primary contributor to the heat transfer mechanism in operation. Rather, a hot-air fan 62 drawing air from second level 58 through an inlet duct 64 conveys heated air from the second level to the first level 60 through outlet duct 66 by means of a hot-air duct 68. It may be noted that hot-air duct 68 is formed over first level 60 and has an annular wall 70 therebetween containing a plurality of perforations (not shown) from distribution of hot air into first level 60. In this manner a forced-air convection mechanism is provided for transferring heat from the parts on the second level 58 to the slugs on the first level 60. As may be appreciated, a large number of parts per hour may be serially loaded onto and off of the tray with many parts being on the trays at the same time.

Figure 2:
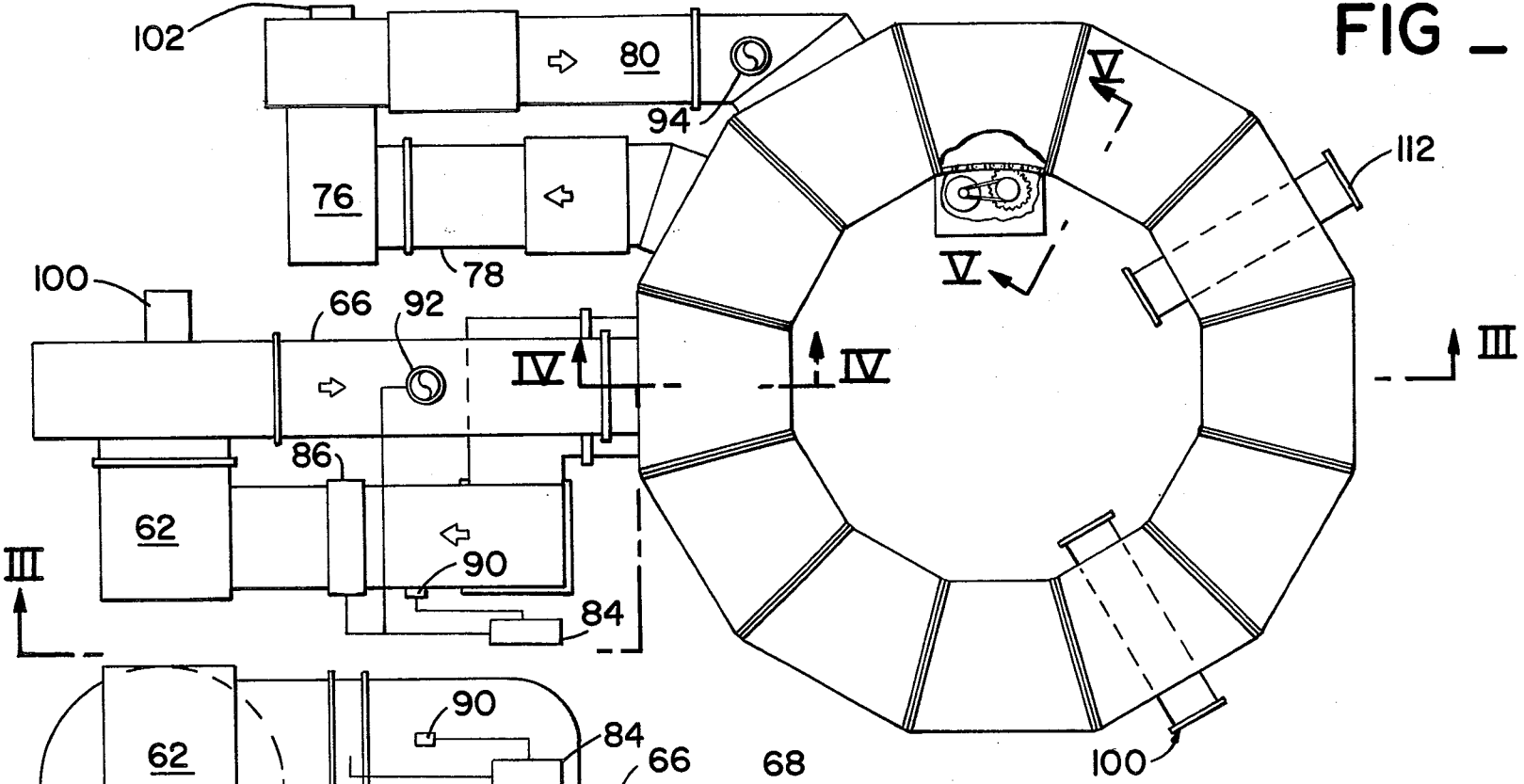
FIG. 2 is a top-plan view of the apparatus of FIG. 1 partially cut away to illustrate details of the drive mechanism.

After the part has reached a temperature of perhaps 500°–800° F and arrives at the third level 72, a quenching operation takes place as the part slowly rotates around third tier tray 30. Quenching is accomplished by means of nozzles 74 arranged around the third level. The water/air mixture that occurs within the level is made to circulate by means of a cold-air fan 76 having an inlet duct 78 connected to the third level 72 and an outlet duct 80 connected to a cold-air duct 82 which is arranged below third level 72, as seen in FIGS. 2 and 3. A plurality of perforations in tier tray 30 permits the flow of the water/air mixture into the third level 72.

Since the heat given off by the formed workpieces varies with mechanical working of the parts, and this is not always directly matched to requirements of the preheating of the slug, a temperature controller 84 is provided in conjunction with the hot-air fan 62 for regulating the temperature of the hot air which flows in the arrow direction from second level 58 through the fan and into hot-air duct 68. If the air is too cool, a duct heater 86 is energized by the controller to heat the air at the inlet to hot-air fan 62. If, on the other hand, the incoming air is too warm, the controller opens a first butterfly valve 92 in order to bleed off warm air and thereby reduce the temperature of the incoming air. A temperature sensor 90 within duct 64 senses the temperature of the incoming air to hot-air fan 62, and causes the controller to properly regulate the air temperature.

As may be seen in FIG. 2, first butterfly valve 92 is located on the top of outlet duct 66 and permits removal of hot, dry air for plant process and space heating requirments. Similarly, a second butterfly valve 94 on the top of duct 80, leading from cold-air fan 76, permits removal of wet, warm air for similar uses, but most especially plant process requirements. As seen in FIG. 1, ducts 96, 98, respectively, leading from butterfly valves 92, 94 permit removal of excess air to remote locations where the thermally humidity-conditioned air may pass through heat exchangers (not shown). Turning to FIGS. 2 and 3, it may be appreciated that hot and cold air at 62, and 76, respectively, are driven by means of motors 100, 102. Also referring to these figures, the motor drive means for the various trays may be seen to consist of first, second and third motors 104, 106, 108, respectively, associated with the first, second and third tier trays 26, 28, 30. As may be also appreciated from FIG. 2, the mechanisms for loading and unloading onto the first tier tray are shown generally at 110. Similarly, a mechanism for loading onto the second tier tray is shown generally at 112. These mechanisms are any loading mechanisms as are conventional, such as reciprocable plunger mechanisms similar to the aforementioned exit/loading mechanism 59 of FIG. 1. It is therefore believed that no further discussion of these mechanisms is necessary.

Figure 5:
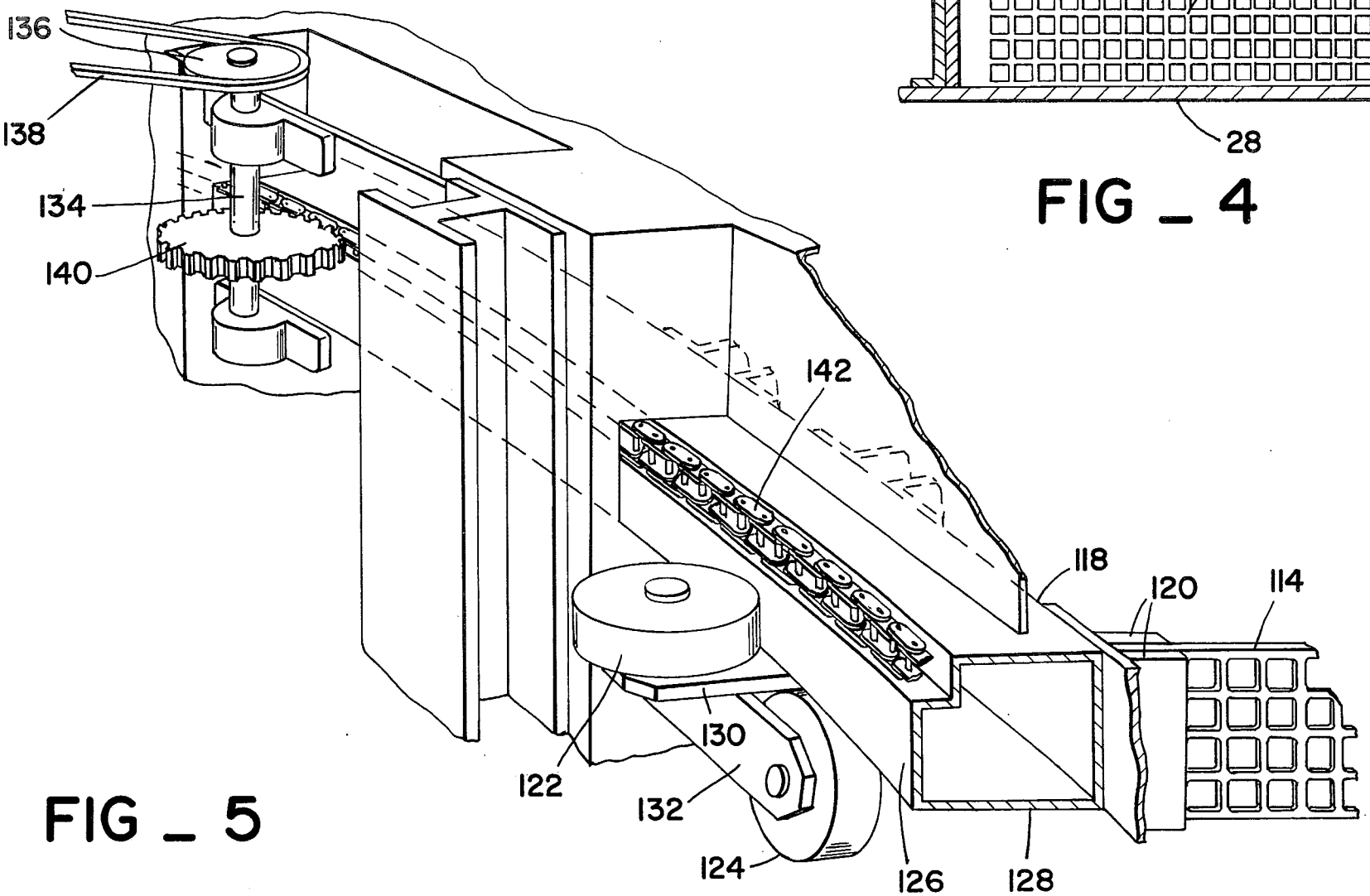
FIG. 5 is an enlarged top-quarter isometric view taken along lines V—V in FIG. 2, and showing details of the drive mechanism.

Turning to FIGS. 4 and 5, a more detailed showing of the drive means or mechanisms formoving the slugs and workpieces around the trays will be described by having reference to these figures. Shown by way of exemplary illustration in FIG. 4, a grate-formed arm or paddle 114, slightly spaced from tier tray 28, is movable over the tier tray to sweep the workpiece ahead of it. This is but one of a plurality of such paddles in association with both the second tier tray and the first tier tray (not shown). Similarly, a plurality of such paddles are associated with the third tier tray. In this manner, the workpiece on the lowermost tier tray are also moved along that tray. As seen in FIG. 3, a layer of insulation 116 thermally uncouples the upper two trays from the lowermost tray.

Turning to FIG. 5, it is seen that each of the paddles 114 is joined to a box-shaped annular ring 118 in spaced relation therealong. Alternatively, an angle may be used in place of a box section with the paddles fixed thereto by gusset plates (not shown). The paddles are joined at one end to the ring by means of a pair of L-shaped brackets 120 and are fixed to the ring by suitable means such as welding. As may be appreciated by referring to FIG. 1, these spaced paddles provide compartments for carrying along workpieces or slugs therebetween on the particular tier trays. Returning to FIG. 5, each ring is shown to be supported by a plurality of rollers, a pair of which are shown at 112, 124. Roller 122 is a horizontally extending roller on the interior of ring 118 and bears against its inner surface 126. Similarly, vertically oriented roller 124 bears against bottom surfaces 128 of ring 118. Each roller is mounted to the housing at a point (not shown) by means of suitable brackets 130, 132. In this manner, the ring and consequently the panels attached thereto are mounted for rotation. The drive mechanism for rotating the rings consists of a vertical shaft 134 journalled between two pillow blocks. Drive is imparted to the ring by means of a drive sprocket 136 connected to a motor (not shown) by means of a drive chain 138. A second drive sprocket 140 example, mounted on the shaft and meshes with, for examle, a drive chain 142 which circumscribes the interior wall 126 and is welded or otherwise fastened to the ring 118. Alternative drive means may be used, such as a hydraulic drive motor, as will be hereinafter described.

Figure 6:
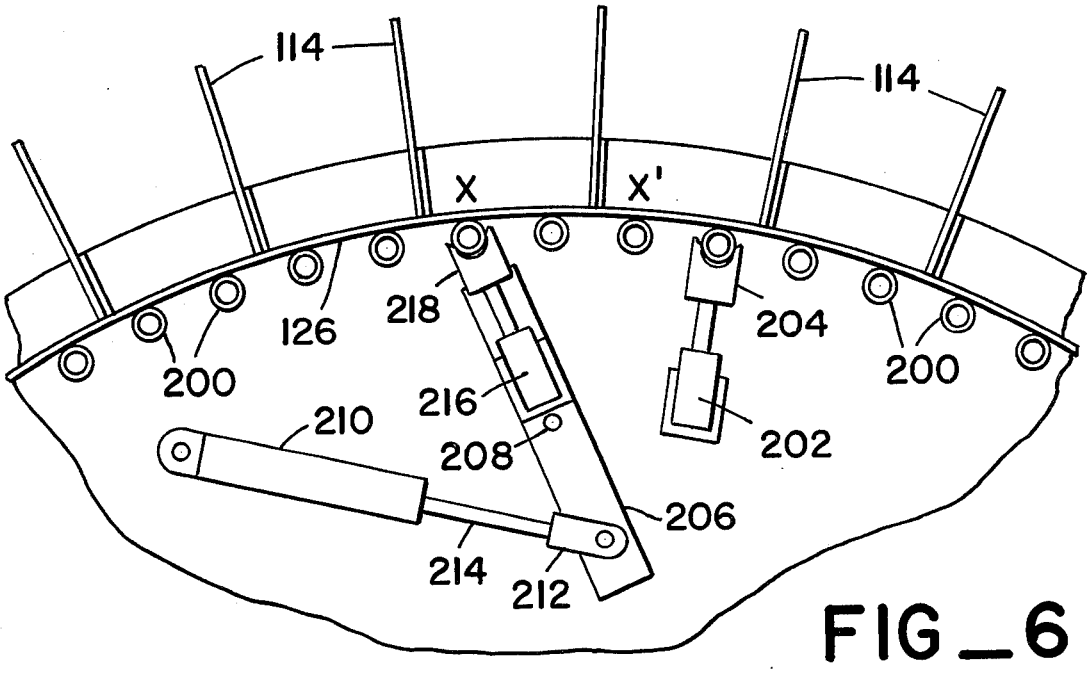
FIG. 6 is a top-plan view of an alternate drive mechanism.
Figure 7:
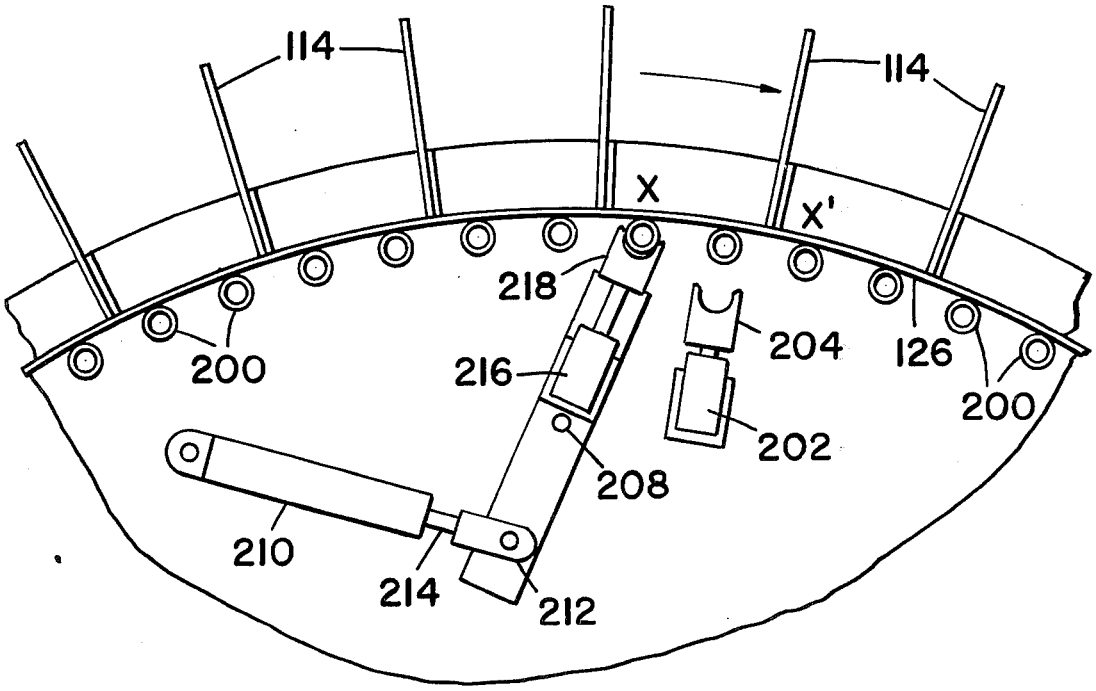
FIG. 7 is a view of the same showing the drive mechanism advanced.

Turning to FIGS. 6 and 7, there is shown an alternate hydraulic drive mechanism to the gear drive mechanism previously described. With this mechanism a plurality of cogs 200, such as short lengths of pipe are fixed as, e.g., by welding, to annular ring 118. The cogs are fixed with their length axis vertical on the inner surface 126 of the ring.

A hydraulic locking cylinder 202 is bearing a C-shaped gripping member 204 on the cylinder rod positioned to be releasably engageable with the cogs 200. The drive means includes an index arm 206 having a central pivot 208. A hydraulic index cylinder 210 has a clamp 212 fixed to the rod 214 thereof for imparting pivotal movement to the index arm.

Movable with the index arm and fixed to the opposite end thereof is a hydraulic index cylinder 216 having a C-shaped gripping member 218 for releasably engaging the cogs.

In operation, hydraulic means (not shown) are used to retract gripping member 204 by actuation of cylinder 202, and at the same time index cylinder 216 is actuated so that it engages a cog at position X as seen in FIG. 6.

The index cylinder 210 is then actuated to retract and pivot, which causes index arm 206 pivot, and in turn causes the cog at position X to advance to position X'. Locking cylinder 202 is then actuated to lock ring 118, index cylinder 216 is then disengaged, and arm 206 is pivoted back to its original position (see FIG. 6). By repetitive action, the ring 118 is incrementally advanced.

It is believed that the operation of the apparatus can be readily appreciated from the foregoing. However, the following example is presented to illustrate the operation of the device if needed. Returning to FIG. 1, the operation of te device shall be illustrated by means of consideration of an unformed metal billet 32 of ambient temperature (70° F) which is loaded onto the topmost tray 26 at entry opening 22. Paddles 114 cause the cooled slug or billet tomove in the arrow direction, picking up heat, as at 32*a*, from counter-rotating finished parts on the next lower or second tray 28 moving in that arrow direction. Of course, the heat given off by workpiece 42*b* is a result of the heat engendered thereto by the mechanical working in warm-form press 12, as well as the initial preheat. The slugs enter the tunnel 14 at 70° F and exit as shown at 32*b* at 265° F. At the same time, the formed workpieces enter the tunnel on conveyor 44 after forming at 1,300° F and exit at 580° F down chute 48 to the lowermost tray 30. As shown in FIGS. 2 and 3, fluid such as air is circulated in the tunnel to provide forced convection heat transfer between the first and second trays. The circulating air is maintained at 500° F by removing 1,300 S.C.F.M. of 500° F air which is made up by 1,800 S.C.F.M. of 70° F air (ambient air). This represents a heat recovery of $0.25 \times 10^6$ BTU/hr. to the preheated parts, and $0.86 \times 10^6$ BTU/hr. to the exhausted air. As aforementioned, this circulation is through ducts 64 and 66 by way of hot-air fan 62.

The workpieces at 580° F are quenched on the third or lowermost tray 28. Here, the temperature of the piece is reduced from 580° F. The moist air created by the spray nozzle 74 atomizing cool water which is circulated over the workpieces is maintained at 200° F by removing 1,600 S.C.F.M. of 200° F air which is made up by 1,600 S.C.F.M. of 70° F air. This exhausted air represents a heat recovery of $0.25 \times 10^6$ BTU/hr. Air from the counterflow heat exchange is mixed with air from the quenching operation for a total of 3,400 S.C.F.M. of 350+ F air. The total heat recovery through exahusted air and preheated workpieces is $1.36 \times 10^6$ BTU/hr. The example illustrated is based upon processing 120,80-pound parts per hour.

It is to be understood that the foregoing description is merely illustrative of the preferred embodiment of the invention, and that the scope of the invention is not to be limited thereto but is to be determined by the scope of the appended claims.

What is claimed is:

1. A heat transfer apparatus for controlling the temperature of a workpiece comprising:

a housing;

a first generally horizontal annular tray in said housing for receiving a workpiece to be preheated;

means for serially loading workpieces to be preheated onto said first tray at a first station;

means for moving said workpieces on said first tray in a first direction to a second station;

means for unloading said workpieces from said first tray at a second station spaced from said first station;

a second generally-horizontal annular tray in said housing for receiving heated workpieces;

means for serially loading said heated workpieces onto said second tray at a third station;

means for moving said workpieces on said second tray in a second direction to a fourth station;

means for unloading said workpieces from said second tray at said forth station; and, further including hot fluid-flow means for directing fluid over said heated workpieces on said second tray thereby removing heat from said workpieces on said second tray and heating said fluid and then directing said heated fluid to flow over said workpieces on said first tray so as to assist in preheating said workpieces on said first tray.

2. The apparatus of claim 1 further including fluid temperature control means for regulating the temperature of the fluid that is directed onto said first tray.

3. The apparatus of claim 1 further including means mounting said first tray in vertical spaced relation with respect to said second tray so that heat may be transferred therebetween.

4. The apparatus of claim 3 further including:

a third generally horizontal annular tray in said housing for receiving heated workpieces from said second tray when they have reached said fourth station and have been cooled;

means for unloading said cooled workpieces from said fourth station of said second tray onto a fifth station of said third tray;

means for moving said cooled workpieces on said third tray in a third direction to a sixth station; and means for unloading said workpieces from said third tray at said fourth station.

5. The apparatus of claim 4 further including controlled quenching means for quenching and thereby cooling said workpieces on said third tray.

6. The apparatus of claim 5 wherein said quenching means comprises spray nozzle means for atomizing liquid to a moist fluid.

7. The apparatus of claim 6 further including cold fluid-flow means for circulating moist fluid to and from said third tray and thereby to the workpieces thereon.

8. The apparatus of claim 7 wherein said cold fluid-flow means comprises a cold-air fan and conduit means communicating said third tray with an annularly shaped cold-air duct thereunder.

9. The apparatus of claim 4 wherein said means for moving said workpieces on said first, second and third trays comprise means drivingly connected to arm means for moving over said trays and pushing workpieces therearound.

10. The apparatus of claim 9 wherein said means for moving said workpieces on said first, second and third trays comprise a plurality of elongated arms fixed at one end thereof to a rotatable drive ring for each tray, a plurality of spaced cogs on said drive ring, locking means for releasably locking said drive ring by selective engagement with said cogs, and index means selectively engageable with said cogs for selective advancement of said drive ring.

11. The apparatus of claim 5 wherein said drivingly connected means comprise a motor, said arm means comprise a plurality of elongated arms fixed at one end thereof to a rotatable drive ring for each said tray, and drive means drivingly interconnecting said motors to each said drive ring for causing movement of said arms around said trays.

* * * * *